United States Patent [19]

Scheidler et al.

[11] 4,363,956

[45] Dec. 14, 1982

[54] COOKING PANEL UNIT FOR INSTALLATION IN WORK SURFACE

[75] Inventors: Herwig Scheidler, Mainz-Finthen, Fed. Rep. of Germany; Günther Keller, Völs, Austria

[73] Assignee: JENAer Glaswerk Schott & Gen., Fed. Rep. of Germany

[21] Appl. No.: 244,055

[22] Filed: Mar. 16, 1981

[30] Foreign Application Priority Data

Mar. 14, 1980 [DE] Fed. Rep. of Germany ..... 3009961

[51] Int. Cl.[3] ..... H05B 3/68

[52] U.S. Cl. ..... 219/464; 219/459; 219/463; 219/467

[58] Field of Search ..... 219/452, 445, 457, 458, 219/459, 460, 461, 462, 463, 464, 465, 466, 467, 448, 449; 49/324

[56] References Cited

U.S. PATENT DOCUMENTS

| | | | |
|---|---|---|---|
| 3,739,149 | 6/1973 | Fischer et al. | 219/464 X |
| 3,838,249 | 9/1974 | Detterbeck | 219/460 |
| 3,909,592 | 9/1975 | Eide | 219/462 |
| 3,944,786 | 3/1976 | Detterbeck | 219/464 X |
| 4,150,280 | 4/1979 | Hurko | 219/461 |

FOREIGN PATENT DOCUMENTS

| | | | |
|---|---|---|---|
| 2819118 | 10/1979 | Fed. Rep. of Germany | 219/464 |

*Primary Examiner*—Volodymyr Y. Mayewsky

*Attorney, Agent, or Firm*—Hill, Van Santen, Steadman, Chiara & Simpson

[57] ABSTRACT

A glass-ceramic cooking panel unit of the type having a glass-ceramic plate overlying heating elements is provided with threaded spring mounting connections in the frame. The connections permit adjustments to be made during installation of the unit in the vertical position of the cooking plate relative to the surrounding work surface. The frame design also permits a simplified access to the unit after installation when servicing is required.

16 Claims, 7 Drawing Figures

COOKING PANEL UNIT FOR INSTALLATION IN WORK SURFACE

BACKGROUND OF THE INVENTION

1. Field of the Invention

The present invention relates to a glass-ceramic cooking panel unit. More particularly, the present invention relates to such a cooking unit which is typically inserted into or received by a counter-top or other like work surface.

2. Description of the Prior Art

The above-described cooking units with a glass-ceramic cooking surface and having completely assembled electrical components have long since proven themselves in the market place. It is known and disclosed in the prior art to provide cooking panel units constructed with a support frame on all sides by which the cooking unit is suspended in an opening which has been cut out of a work surface. The supporting frame of the unit is attached to a surrounding frame by fasteners such as screws or by a clamping connection—forming a moisture-tight seal. The cooking surface itself is either clamped in the support frame and sealed with an elastic sealing profile or is glued and sealed to the support frame using a resilient, temperature-stable adhesive. German O.S. No. 2,819,118 may be seen in this regard. A smooth, flush connection between the surrounding work surface and the cooking surface plate cannot be achieved by using either of these methods.

Cooking panel units designed without a support frame which surrounds on all sides, are also known. These units are suitable for direct, surface-flush installation into work surfaces consisting of wood, ceramics or synthetics. The cooking surface is inserted so its surface is flush with the surrounding work surface using alternative constructions. The remaining gap between the cooking surface and the working surface is later grouted closed.

The disadvantage to these "frame-less" cooking panels is that installation is burdensome because it is very difficult to align the level of the cooking surface with that of the work surface surrounding the opening. This is particularly a problem where the work surface consists of non-planar surfaces, for example with tiled surfaces a sufficiently defined reference plane is not available. A further difficulty with this type of built-in design arises when servicing of the unit is required. The cooking surface can only be removed with great difficulty and only after the grouting has been removed. If the cooking surface is not removed, all servicing must be done "from below" the built-in cooking panel unit. Due to the normally tight working area, this is frequently very laborious.

SUMMARY OF THE INVENTION

The present invention has as an underlying objective the creation of a cooking panel unit without the above-mentioned disadvantages, making possible the installation and servicing of the unit in a simple, straightforward manner. In addition, this cooking unit provides other advantages during its use, as will hereinafter be described.

The resolution of these objectives is attained by inventively providing a cooking panel unit which permits the vertical adjustment of the cooking surface after installation of the entire unit in a counter or other work surface. The unit is designed so as after the mounting frame has been received and secured in the mounting opening in the counter or work surface, the cooking surface panel may freely be adjusted in a vertical manner until the edges of the cooking surface and the surrounding edges of the work surface have the desired pre-selected height relationship. Under the present invention, the height adjustment of the cooking panel is achieved by several threaded, spring connections located about the circumference of the cooking panel.

By having the cooking panel height-adjustable, the installation tolerances for the mounting frame are much less critical and thus more easily and inexpensively achieved. Additionally, the adjustability makes possible other height relationships besides that of being flush with the surrounding work surface. It is also possible to provide a cooking surface which lies above or below the surrounding counter surface. This flexibility adds to the usefulness of the cooking unit, making possible additional benefits for certain employments of the unit. After the desired height relationship is established, the joint between the cooking surface and the surrounding work surface can be grouted with any of various sealants, but preferably with a resilient adhesive.

Various other objects, advantages, and features of the present invention will become readily apparent from the ensuing detailed description and the novel features will be particularly pointed out in the appended claims.

DESCRIPTION OF THE PREFERRED EMBODIMENTS

Figure 1:
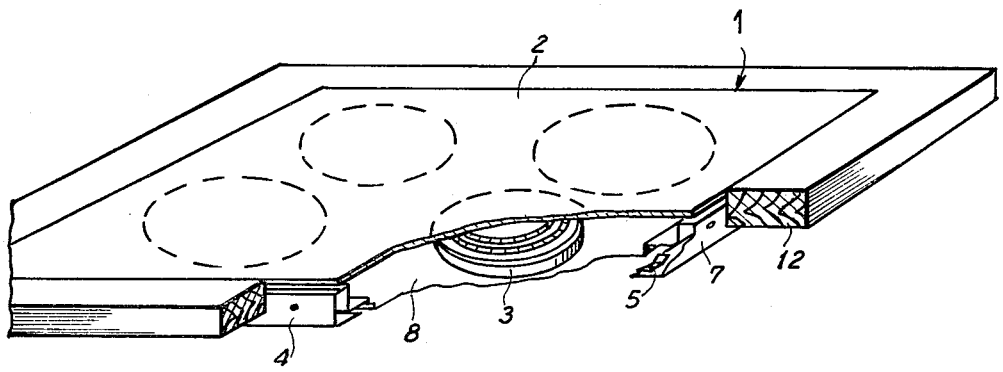
FIG. 1 is a perspective view with a portion broken away, showing a cooking panel unit as built into a counter or work surface.

FIG. 1 shows a cooking panel unit 1 which has been installed in a counter or other work surface 12. The mounting frame 4 is first secured in an opening in the work surface to a high tolerance of approximately ±0.5 mm using screws 15. An elastic sealant layer 10 is applied to an upper leg portion 4*a* of the mounting frame 4 circumferentially about the work surface opening. The cooking panel unit 1 is then positioned loosely on the sealant layer 10. The cooking panel unit 1 is of the type which is fully functional, containing the cooking surface 2, the heating element assemblies 3, wiring and temperature regulators (not shown), meeting all safety standards and requirements.

A plurality of spring elements 5, preferably leaf springs, are positioned and openings for the screws 6 are constructed on the inside surface of the lower leg portion 4*b* of the mounting frame 4.

Figure 3:
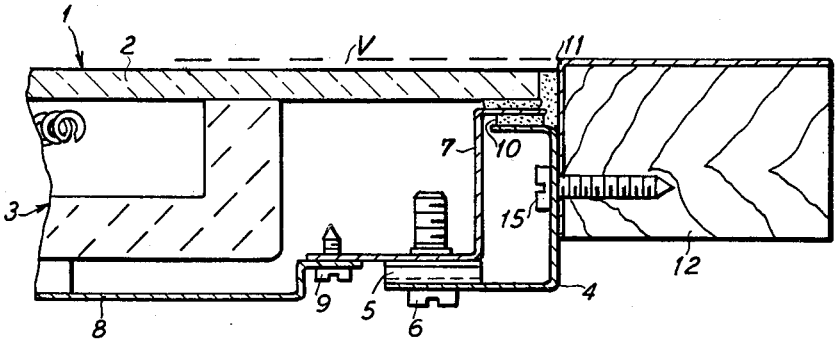
FIG. 3 is a view similar to that shown in FIG. 2, and wherein the cooking surface is displaced below the level of the surrounding work surface.
Figure 4:
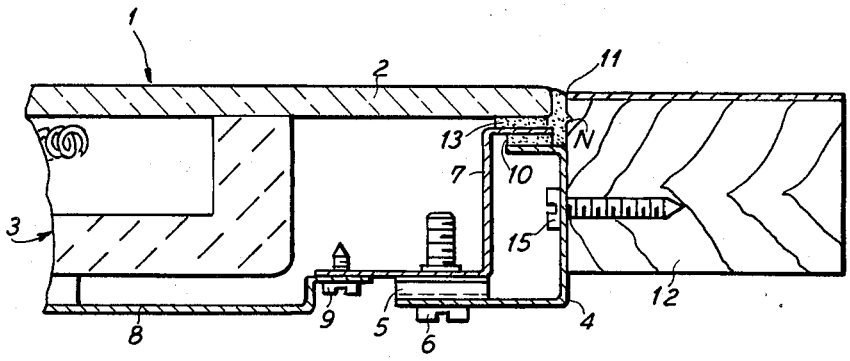
FIG. 4 is a view similar to that shown in FIGS. 2 and 3, and wherein the cooking surface is displaced above the level of the surrounding work surface.
Figure 5:
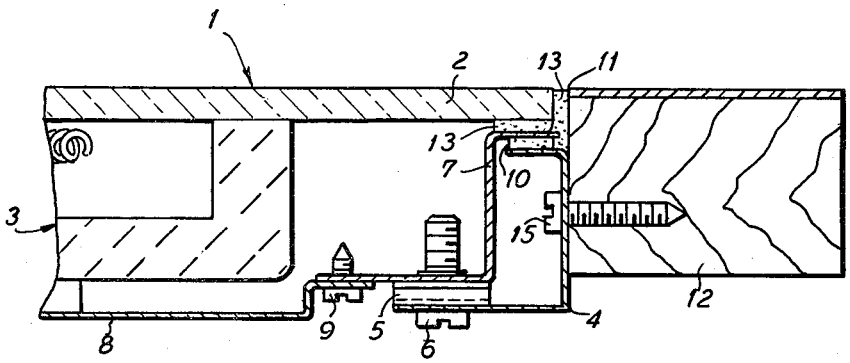
FIG. 5 is a view similar to that shown in FIGS. 2, 3, and 4, showing an alternate means of mounting the cooking unit in the surrounding working surface.
Figure 7:
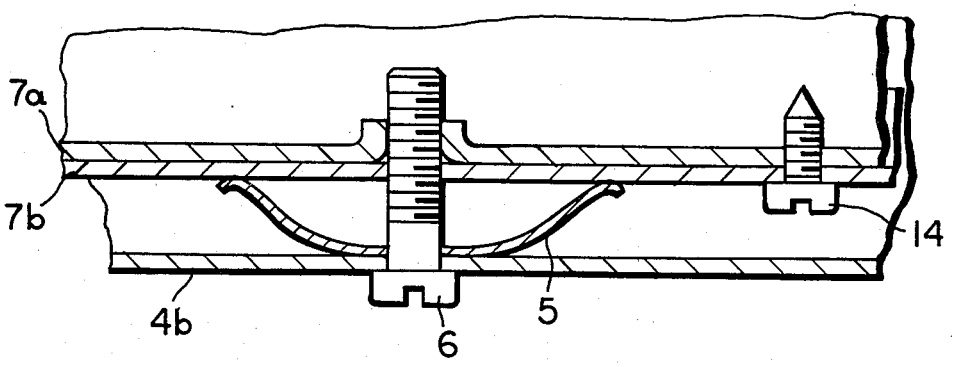
FIG. 7 is a partial sectional view taken along arrow VII in FIG. 2 of the cooking unit.

The screws are received by the openings which are located peripherally around the mounting frame 4, and extend into screw nuts or the like located at matching locations on a trough or side frame 7 of the cooking panel unit 1, see FIGS. 3–5. Screws 6 may thus be utilized to connect and clamp down the cooking unit 1 to the mounting frame 4. In addition, due to the spring elements 5, a friction type locking connection is achieved. FIG. 7 shows this connection in detail.

The screws 6 are uniformly tightened about the periphery until the edges of the cooking surface 2 lie flush with the surrounding edge 11 of the opening in the work surface 12. This leveling may easily be effected, for example using a ruler or other straight edge. After the cooking panel unit 1 has been installed as is described above, the joint between the cooking surface 2 and the surrounding edges 11 is grouted, a temperature-stable, resilient silicon adhesive 13 being preferable.

A suitable anti-seize agent may be applied to the peripheral inside surface of the opening in the work surface prior to grouting with the resilient adhesive 13. In this manner, the grouting produces an adequate moisture seal while the anti-seize agent prevents the formation of a tight mechanical connection. Thereby, when the screws 6 are loosened, the spring elements 5 automatically press against the cooking panel unit 1 causing it to move upwardly without the need of additional measures. When servicing or replacing the cooking panels is required, this ability of the cooking unit to easily move up can be very advantageous.

Figure 2:
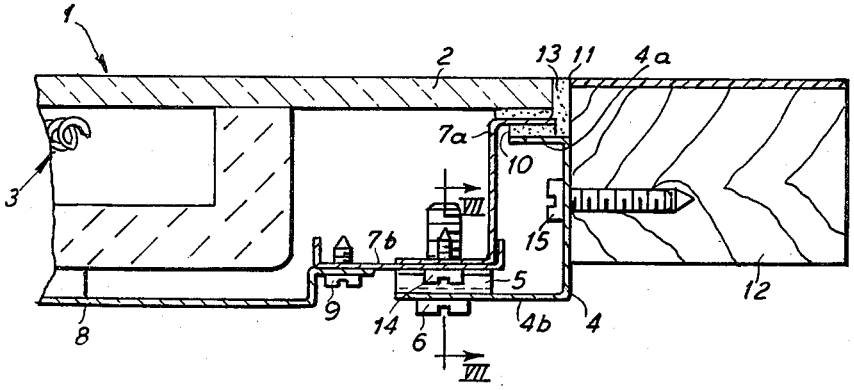
FIG. 2 is a side elevational view in section showing an outer, circumferential portion of the cooking unit and an adjoining portion of the surrounding work surface.

As shown in FIG. 2, the trough frame 7 of the cooking unit 1 may be divided into two pieces, an upper first frame 7*a* and a lower second frame 7*b*, connected by a plurality of screws 9 and 14. In this embodiment, loosening screws 14 permits removal, from the top, of the cooking surface 2 by itself. Access to screws 14 from below is obtained by loosening screws 6, and raising the cooking panel unit 1. After the removal of the screws 14, the anti-seize agent permits the cooking surface 2 to move upwardly and out of the opening, along with the upper first frame 7*a* to which it is attached by the resilient adhesive 13. This leaves the heating elements, connection lines, temperature displays, and any other additional components freely accessible from the top. This of course greatly simplifies many servicing problems as the cooking panel unit 1 no longer has to be completely dismantled with the wiring disconnected from the switches.

Alternatively, if the screw connections 9 are released, a bottom plate 8 of the cooking unit 1 may be removed from the bottom. This makes possible the replacement of heating element assemblies 3 while the cooking panel unit 1 remains installed in the work surface 12. If all of the electrical components are secured to the bottom plate 8, then removal of the screw 9 permits removal of the electrical components to an area of easier accessibility for servicing. As described in the foregoing, the inventive cooking panel unit makes possible a simplified installation for a surface-flush fit while permitting great ease of servicing.

Other arrangements besides having the cooking surface 2 flush with the edges 11 of the surrounding work surface 12, (FIG. 5), are possible. As illustrated in FIG. 3, the cooking surface 2 is built in more deeply, the edges of the cooking surface 2 lying approximately 1–3 mm deeper than the surrounding edges 11 of the opening in the work surface 12. In this way, a certain overflow volume (v) for the cooking surface is obtained.

In FIG. 4, the cooking surface 2 is adjusted so as to be higher than the surrounding edges 11 of the work surface 12. In this embodiment, pots and pans resting on the cooking surface 2 will not make contact with the top of the surrounding work surface 12 when they are moved partially off the surface 2. This method of construction is also appropriate when the edges 11 of the work surface opening are not of a uniform level, for example with tiled surfaces.

FIG. 4 also illustrates an installation embodiment when the cooking unit 1 is installed in a wooden working surface 12. In order to provide a better anchorage for the sealant 13, a groove N is cut into the inside surface of the opening in the work surface 12.

Figure 6:
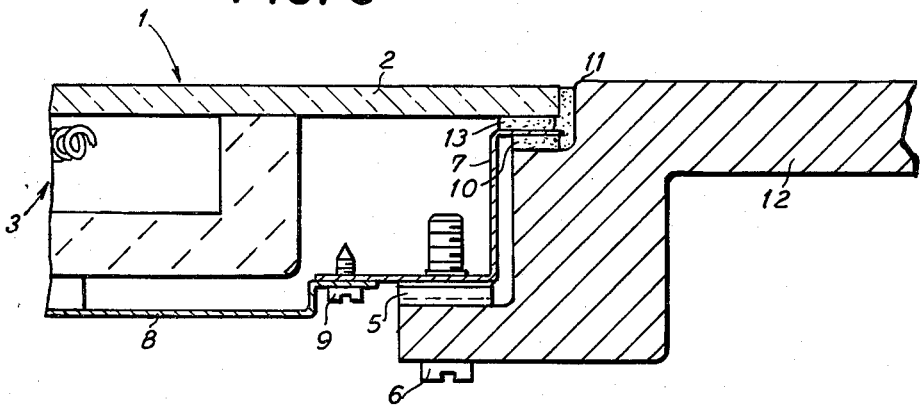
FIG. 6 is a view similar to that shown in FIGS. 2–5, showing a further means of mounting the cooking unit in the surrounding working surface.

Besides working surfaces constructed of wood, the present invention is also applicable for such surfaces consisting of ceramics, synthetics or metals, for example a stainless steel work surface. In such surfaces, it is advantageous if the mounting frame is formed in the work surface. As is shown in FIG. 6, the frame upon which the cooking unit 1 is mounted, is formed out of the stainless steel work surface 12. This "one-piece" frame in turn has the spring elements 5 attached and includes bores for the screws 6. This embodiment is advantageously employed when individual cooking areas are to be seamlessly fitted into large, stainless steel work surfaces.

Of course under the present invention the cooking panel units are not limited to only those units of a shape having corners, the invention is equally applicable to round or oval cooking surfaces or surfaces shaped in some other manner. While we have disclosed an exemplary structure to illustrate the principles of the invention, it should be understood that we wish to embody within the scope of the patent warranted hereon all such modifications as reasonably and properly come within the scope of our contribution to the art.

We claim as our invention:

1. In an improved glass-ceramic cooking panel unit having a glass-ceramic cooking plate overlying the remainder of the cooking unit containing the heating element assemblies, wiring, and temperature regulators, and which are surrounded by a side or trough frame and a bottom plate, the cooking panel unit is of the type to be received by a peripheral mounting frame which is attached to both the cooking panel unit and to a surrounding counter or work surface, the improvement which comprises:

biasing means disposed between a cooking panel unit and a mounting frame comprising:

a plurality of spring elements location between said cooking panel unit and said mounting frame, and a plurality of adjustable connecting means attached the panel unit to the mounting frame, whereby the cooking panel unit and the mounting frame are placed in a continuously height-adjustable, biased relationship.

2. An improved cooking panel unit as described in claim 1 wherein the adjustable connecting means comprises a screw which is screwed into the cooking panel unit from below the unit, through a horizontal, lower leg of the mounting frame.

3. An improved cooking panel unit as described in claim 1 or 2 wherein the plurality of spring elements and the plurality of adjustable connecting means are uniformly distributed peripherally around the cooking panel unit.

4. An improved cooking panel unit as described in claim 1 wherein the spring elements and adjustable connecting means engage with a peripherally around the cooking panel unit cooking panel unit, said trough frame is attached to the cooking plate by the means of permanent-elastic, temperature-stable adhesive.

5. An improved cooking panel unit as described in claim 4 wherein a bottom plate for the cooking panel unit is attached to said trough frame.

6. An improved cooking panel unit as described in claim 5 wherein the bottom plate is removably secured to the trough frame by screws whereby all electrical components of the cooking panel unit are freely accessible from below through an opening after removal of the bottom plate.

7. An improved cooking panel unit as described in claim 5 wherein all electrical components for the cooking panel unit including heating elements are attached to and carried by the bottom plate, whereby all electrical components are freely and easily accessible after removal of the bottom plate.

8. An improved cooking panel unit as described in claim 4 wherein said trough frame comprises:

an upper first frame attached to the cooking plate, a lower second frame attached to the mounting frame, and a plurality of screws connecting the first frame to the second frame, whereby the upper first frame may be separated from the lower second frame and the cooking plate selectively removed with all electrical components then freely accessible from above.

9. An improved cooking panel unit as described in claim 1 wherein the plurality of spring elements and adjustable connecting means are dimensioned in such a manner as permitting the adjustment of the cooking plate from an upper horizontal position somewhat above the surrounding work surface to a lower horizontal position somewhat below the surrounding work surface.

10. An improved cooking panel unit as described in claim 9 wherein the upper horizontal position lies between approximately 0.5 to 1 mm above the surrounding work surface and the lower horizontal position lies between approximately 1 to 3 mm below the surrounding work surface.

11. An improved cooking panel unit as described in claim 1 wherein an upper, horizontal leg is provided on the mounting frame, said upper horizontal leg engaging with and supporting the peripheral edge of the cooking panel unit.

12. An improved cooking panel unit as described in claim 11 wherein a water-proof elastic sealant is provided between the cooking panel unit and the upper, horizontal leg to provide a water-tight elastic seal.

13. An improved cooking panel unit as described in claim 1 wherein a mounting frame having a plurality of through-bores is provided along with connecting means of the through-bore dimension whereby the mounting frame may be attached to an opening in the surrounding work surface.

14. An improved cooking panel unit as described in claim 13 wherein the connecting means consist of screws or bolts.

15. An improved cooking panel unit as described in claim 1 wherein the spring elements are leaf springs.

16. An improved cooking panel unit as described in claim 1 wherein a mounting frame which is formed in the surrounding work surface is provided.

* * * * *